United States Patent [19]

Ichijo

[11] 4,111,688

[45] Sep. 5, 1978

[54] METHOD FOR SEPARATING GOLD FROM ACID AQUEOUS SOLUTION

[75] Inventor: Michio Ichijo, Kawaguchi, Japan

[73] Assignee: Agency of Industrial Science and Technology, Tokyo, Japan

[21] Appl. No.: 827,463

[22] Filed: Aug. 25, 1977

[30] Foreign Application Priority Data

Aug. 25, 1976 [JP] Japan ..... 51-101416

[51] Int. Cl.[2] ..... C22B 11/10

[52] U.S. Cl. ..... 75/118 R; 75/0.5 A; 75/109; 75/114; 204/126

[58] Field of Search ..... 75/118 R, 118 P, 109, 75/114, 111, 0.5 A, 0.5 R; 204/126

[56] References Cited

U.S. PATENT DOCUMENTS

| | | | |
|---|---|---|---|
| 3,729,182 | 4/1973 | Schafer et al. | 75/109 |
| 4,019,971 | 4/1977 | Crites | 204/126 |

FOREIGN PATENT DOCUMENTS

| | | | |
|---|---|---|---|
| 142,631 | 3/1931 | Australia | 204/126 |

*Primary Examiner*—M. J. Andrews

[57] ABSTRACT

A method for separating gold etc. from acid aqueous solution comprising a first step in which a silver amalgam with high silver content is added to acid aqueous solution containing gold to precipitate metallic gold, a second step in which silver amalgam with low silver content is added to the mother liquor from the first step to thereby separate silver amalgam in the mother liquor and a third step in which amalgam of base metal other than mercury is added to the mother liquor from the second step to thereby separate residual silver and mercury present in the mother liquor as a silver amalgam, or alternatively the mother liquor from the second step is electrolyzed by using mercury as a cathode to thereby precipitate residual silver and mercury present in the mother liquor as a silver amalgam on the cathode.

12 Claims, No Drawings

METHOD FOR SEPARATING GOLD FROM ACID AQUEOUS SOLUTION

BACKGROUND OF THE INVENTION

1. Field of the Invention

The present invention relates to a method for separating and recovering gold with high selectivity from acid aqueous solution including gold in a form of ion or salt without undergoing undesired affects by another metallic ions.

2. Description of Prior Arts

It has been widely performed in old days to separate gold and silver by amalgam process from gold ore and silver ore, while today such the amalgam process has almost not employed since there have been lessened gold ore and silver ore with high content of the noble metals which are adapted for such the amalgam process and further because of the problems of enviornmental pollution produced by using mercury in such the amalgam process. The amalgam process has, however, the following adavantages that consumption of energy is small, and thus the process is economical of energy and that those noble metals may be efficiently separated by relatively simple operation. Accordingly, the amalgam process is expected to have possibility of bein again utilized as an excellent method for separating gold and silver by resolving the problems of enviormental pollution coming from use of mercury and by improving a process to be able to be adapted for separating gold and silver from low content ore. Further, it has been requested to separate efficiently gold or silver from worn-out gold plated or silver plated products, or electrolytic slime containing partly gold or silver and other materials, but however, advantageous method responsive to the requirement has hitherto not been known.

SUMMARY OF THE INVENTION

Main object of the present invention is, therefore, to provide a method for separating gold selectively by an amalgam process from material containing gold, which is advantageous from the industrial viewpoint.

Another object of this invention is to provide a method for separating gold efficiently by an amalgam process from acid aqueous solution containing gold.

Still another object of the invention is to provide a method for separating gold and silver in order by an amalgam process from acid aqueous solution containing gold and silver.

These and other objects, features and advantages of this invention will become readily apparent from further disclosure of this specification and appended claims.

DETAILED DESCRIPTION OF THE INVENTION

First of all, in the present invention, the gold of material containing gold such as gold ore or silver ore, or the gold of solid matter containing gold such as electrolytic slime is dissolved into aqueous solution to prepare a starting aqueous solution. The dissolution of gold from a solid matter may be performed by known prior art methods, for example, the method that a solid matter is dipped in hydrochloric acid in the presence of an oxidizing agent such as chlorine. Needless to say, such the starting aqueous solution is, even if obtained by another process, also acceptable. Although gold concentration in the starting aqueous solution employed in the present invention is not particularly limited, the concentration is ordinarily from 100 g/ to 50 g/ and pH of the starting aqueous solution is usually from 0 to 6, preferably from about 1 to about 3. A starting solution used in the present invention is optional if gold is contained therein, and also is acceptable even if another metallic ion is contained. According to this invention, it is possible to separate selectively only gold from aqueous solution containing other metals, besides gold, such as silver, mercury, copper, lead, cadmium, zinc etc. In the case silver is also contained in aqueous solution in addition to gold, even if further metal is contained therein, the gold and the silver may be separated in order without undergoing undesired affects by the another metals.

The method of this invention comprises a first step in which silver amalgam having high silver content is added to acid aqueous solution containing gold to precipitate metallic gold; a second step in which silver amalgam having low silver content is added to the mother liquor from the first step in which gold is separated, to thereby separate the silver as silver amalgam in a substantial amount present in the mother liquor; and a third step wherein amalgam of base metal other than mercury is added to the mother liquor from the second step in which silver amalgam is separated, to thereby separate residual silver and mercury present in the mother liquor as silver amalgam, or alternatively the mother liquor from the second step is electrolyzed by using mercury as a cathode, thereby precipitating residual silver and mercury present in the mother liquor as silver amalgam on the cathode.

The first step to precipitate selectively gold from aqueous solution is carried out in the presence of sodium chloride in a manner that silver amalgam is added into a starting aqueous solution to be mixed therewith, whereby silver amalgam contacts gold ions contained in the aqueous solution. Content of silver of silver amargam to be added is 30% by weight or more, ordinarily from 40 to 50% by weight. By this treatment, gold ions in the aqueous solution are reacted with silver amalgam to be converted into metallic gold which is precipitated from the solution.

$$(m+2n)An^{3+} + 3Ag_m.Hg_n \xrightarrow[NaCl]{} (m+2n)An\downarrow + 3mAg^{+} + 3nHg^{2+} \quad (1)$$

(In the formula, $Ag_m.Hg_n$ indicates silver amalgam.)

In the present invention, the amount of sodium chloride which should be present in aqueous solution is preferably in great excess of the amount of metallic ions contained in the aqueous solution, in ordinary, 100 g/l or more, preferably from about 200 g/l to about 300 g/l, the maximum amount being determined by solubility of sodium chloride to the starting solution. Reaction temperature as high as possible is desirable. In this invention, reaction temperature is 70° C. or higher, ordinarily from 90° C. to 100° C. The amount of silver amalgam to be added to a starting aqueous solution is, in the present invention, no more than a stoichiometric amount to gold ions. In order to precipitate gold from solution, as is apparent from the above reaction formula (1), silver amalgam equivalent to $3/(m + 2n)$ mol to $1/(m + 2n)$ mol of gold ions is consumed, while if the amount of the silver amalgam to be added to aqueous solution is adjusted so as to be not over an amount equivalent to $3/(m + 2n)$ mol times gold ions in the aqueous solution, silver amalgam is all converted into the corresponding ions by reaction with gold ions and thus only precipitated gold remain as not dissolved portion so that the selectable separation of gold is attainable. Thus, the amount of adding silver amalgam ($Ag_m.Hg_n$) is selected in the range of from $2.5/(m + 2n)$ to $3.0/(m + 2n)$ mol times gold ions in the solution, preferably in the range of from $2.7/(m + 2n)$ to $2.9/(m + 2n)$ mol times the gold ions in the solution. Precipitated metallic gold is separated and recovered, the remaining mother liquor being used in the second step.

In the second step, silver amalgam is again added to the remaining mother liquor of the first step containing silver and mercury to separate silver ions present in the mother liquor as amalgam.

$$m'Ag^+ + Ag_{m''}.Hg_{n'} \xrightarrow[NaCl]{} Ag_{m'+m''}.Hg_{n'-m'} + m'Hg^+ \quad (2)$$

(In the formula, $Ag_{m''}.Hg_{n'}$ indicates added silver amalgam and $Ag_{m'+m''}.Hg_{n'-m''}$ indicates formed silver amalgam.)

The silver amalgam ($Ag_{m''}.Hg_{n'}$) to be added to the second step is such that silver content is less 30% by weight, usually from 0.1 to 25% by weight and that the amount of the silver amalgam added is such that silver content of silver amalgam formed exceeds 30% by weight. The reaction in this second step is, as in the first step, performed in the presence of excessive sodium chloride, while since the mother liquor from the first step contains excessive sodium chloride, addition from outside is particularly unnecessary. Reaction temperature is 70° C. or higher. By this reaction, silver content in the solution is heightened and silver amalgam ($Ag_{m'+m''}.Hg_{n'-m''}$) is formed. The silver amalgam so formed is separated from the solution and the remaining mother liquor is employed in the third step. In the reaction, residual amount of silver present in the solution relates to silver concentration in the silver amalgam present in the solution in which if silver content of amalgam is of the order of 30% by weight, the silver concentration in the solution is 0.4 g/l, while if silver content of amalgam is from 40% by weight to 50% by weight, silver concentration indicates respectively from 1 g/l to 2 g/l.

In the present invention, the first step and the second step are performed with a relation therebetween. In other words, the silver amalgam separated in the second step is returned or circulated to the first step, and the silver present in the starting solution is recovered by drawing out a part of circulating silver amalgam outside from the system. In order to make advantageous the circulating use of the silver amalgam, the circulating silver amalgam has so high silver content as to make the handling easy and to make it easy to separate silver from silver amalgam. In other words, silver content of the circulating silver amalgam is 30% by weight or more. The state of the silver amalgam varies according to the silver content. If the silver content is less than 30% by weight, the amalgam shows fluidity but as the silver content becomes over 30% by weight, the fluidity becomes gradually to lose and if hightened to from 40% to 50% by weight, the silver amalgam will become sand-like form. Amalgam of sand-like form has, in addition to handling being easy, high silver content, and thus in case of separating from silver by evaporating mercury, consumed heat energy is less compared with that of amalgam of fluidity.

The third step of this invention is such as to separate residual silver and mercury remaining in the solution as silver amalgam by adding amalgam containing base metals than mercury to the mother liquor of the second step. In this case, the amalgam to be added is such that base metals contained therein are in excess of silver and mercury present in the solution, to thereby separate substantially all the silver and mercury contained in the solution as amalgam.

$$\alpha Ag^+ + \beta Hg^+ + M_{\alpha+\beta}.Hg_\gamma \rightarrow Ag_\alpha.Hg_{\beta+\gamma} + (\alpha+\beta)M^+ \quad (3)$$

(In the formula, M indicates base metal than mercury, for example, copper, lead, zinc etc; $M_{\alpha+\beta}.Hg_\gamma$ indicates amalgam. $Ag_\alpha.Hg_{\beta+\gamma}$ shows formed silver amalgam.)

Instead of the above amalgam process, the third step may be also performed by an electrolysis method in which mercury is used as a cathode. In this instance, silver and mercury present in the solution are precipitated on the cathode.

Silver amalgam ($Ag_{60}.Hg_{\beta+\gamma}$) obtained from the third step as above has low silver content, ordinarily less than 30% by weight. The silver amalgam so obtained is circulated to the second step. Mother liquor left after formed amalgam ($Ag_\alpha.Hg_{\beta+\gamma}$) is selected in the third step is abandoned as waste solution after metals contained in the mother liquor are removed according to a conventional practical method. Further, similarly to the above, metals other than gold and silver present therein may be in order separated by using repeatedly the amalgam process. For example, in case copper and lead are contained in addition to gold and silver in a starting solution, the copper ions are separated as copper amalgam by adding lead amalgam having larger tendency of ionization than copper, and thereafter zinc having larger tendency of ionization than lead is added to separate lead as amalgam.

$$2Cu^+ + Pb.Hg \xrightarrow[NaCl]{} 2Cu.Hg + Pb^{2+} \quad (4)$$

$$Pb^{2+} + Zn.Hg \xrightarrow[NaCl]{} Pb.Hg + Zn^{2+} \quad (5)$$

(In the formulae, Pb.Hg, Cu.Hg and Zn.Hg indicate respectively lead, copper, and zinc amalgams.)

According to a general method of the present invention, a plurality of metals contained in starting solution may be separated in order respectively as shown in the following general formulae.

$$M_1^* + M_2.Hg \rightarrow M_1.Hg + M_2^* \quad (6)$$

$$M_2^* + M_3.Hg \rightarrow M_2.Hg + M_3^* \quad (7)$$

$$M_{n-1}^* + M_n.Hg \rightarrow M_{n-1}.Hg + M_n^* \quad (8)$$

$$M_n^* + Hg + e \rightarrow M_n.Hg \text{ (Electrolysis)} \quad (9)$$

(In the formulae, M* denotes metals present in ionic form in solution and $M_1.Hg \ldots M_n.Hg$ indicate respectively amalgams containing metals $M_1 \ldots$ or $M_n$. Ionization tendency of metals $M_1 < M_2 < \ldots < M_{n-1} < M_n$.)

EXAMPLE (A)

Separation of Gold From Solution 20 g of silver amalgam having 50% by weight of silver content was added to 5 liter of starting aqueous solution containing gold concentration of 2.7 g/l, silver concentration of 2.0 g/l, copper concentration of 0.5 g/l and concentration of sodium chloride of 300 g/l to be reacted at temperature 95° C. while being stirred. 12.7 g of metallic gold was obtained.

EXAMPLE (B)

Separation of Silver From Solution 40 g of silver amalgam having 5% by weight of silver content was added to 5 liter of the solution left after separated metallic gold, i.e., having silver concentration of 4.0 g/l, mercury concentration of 2.0 g/l, copper concentration of 0.5 g/l and concentration of sodium chloride of 300 g/l, which was reacted, as in the example (A), at temperature 95° C. while being stirred. 24 g of silver amalgam having 50% by weight of silver content was obtained. The silver amalgam with 50% by weight of silver content was able to be used again for precipitating metallic gold.

EXAMPLE (C)

Separation of Mercury From Solution 172 g of copper amalgam with 10% by weight of copper content was added to 5 liter of the solution left after separated silver amalgam with 50% by weight of silver content, i.e., silver concentration of 2.0 g/l, mercury concentration of 7.2 g/l, copper concentration of 0.5 g/l and concentration of sodium chloride of 300 g/l, which was reacted, as in the above examples, at temperature 95° C. while being stirred. 200 g of silver amalgam with 5% by weight of silver content was obtained. The silver amalgam so obtained was able to be used cyclically in the above step as aforementioned.

EXAMPLE (D)

Separation of Copper From Solution 213 g of lead amalgam with 15% by weight of lead content was added to 5 liter of the solution left after separated silver amalgam with 5% by weight of silver content, i.e., copper concentration of 4.0 g/l, concentration of sodium chloride of 300 g/l, which was reacted similarly at temperature 95° C. while being stirred. 200 g of copper amalgam with 10% by weight of copper content was obtained. The copper amalgam obtained was able to be used again in the above step as the example (C).

EXAMPLE (E)

Separation of Silver and Mercury From Solution by Electrolysis 5 liter of the solution, as indicated in the example (C), containing silver concentration of 2.0 g/l, mercury concentration of 7.2 g/l, copper concentration of 0.5 g/l and concentration of sodium chloride of 300 g/l was electrolyzed, with 154 g of mercury being used as a cathode, at temperature 95° C. of solution while being stirred. 200 g of silver amalgam with 5% by weight of silver content was obtained on the cathode. The silver amalgam with 5% by weight of silver content so obtained was able to be used cyclically as disclosed in the example (D).

What is claimed is:

1. A method for separating gold from an acidic aqueous solution containing gold comprising the steps of:

(a) selectively precipitating metallic gold from the solution by adding a silver amalgam with 30% by weight or more of silver content to said solution and reacting gold ions with the silver amalgam at a reaction temperature of 70° C. or higher in the presence of an excessive alkali metal chloride;

(b) separating metallic gold from the solution;

(c) forming a silver amalgam with 30% by weight or more of silver content by adding a silver amargam with less than 30% by weight of silver content to the solution from the step (b), and reacting silver ions present in the solution with the silver amalgam at a reaction temperature of 70° C. or higher in the presence of an excessive alkali metal chloride;

(d) separating the silver amalgam from the aqueous solution;

(e) circulating the silver amalgam separated in the step (d) to the step (a);

(f) forming silver amalgam with less than 30% by weight of silver content by adding amalgams of a base metal having a greater ionizing tendency than mercury to the solution from the step (d) and reacting the amalgam with the silver ions and mercury ions remaining in the solution at a reaction temperature of 70° C. or higher in the presence of an excessive alkali metal chloride;

(g) separating the silver amalgam from the solution; and (h) circulating the silver amalgam separated in the step (g) to the step (c).

2. A method as claimed in claim 1, in which the concentration of the alkali metal chloride in the aqueous solution is kept at 100 g/l or more throughout the steps.

3. A method as claimed in claim 1, in which the alkali metal chloride is sodium chloride.

4. A method for separating gold from an acidic aqueous solution containing gold comprising the steps of:

(a) selectively precipitating metallic gold by adding a silver amargam with 30% by weight or more of silver content to said solution, and reacting gold ions with the silver amalgam at a reaction temperature of 70° C. or higher in the presence of an excessive alkali metal chloride;

(b) separating the metallic gold from the solution;

(c) forming a silver amalgam with 30% by weight or more of silver content by adding a silver amalgam with less than 30% by weight of silver content to the solution from the step (b), and reacting silver ions with the silver amargam present in the solution at a reaction temperature of 70° C. or higher in the presence of an excessive alkali metal chloride;

(d) separating the silver amalgam from the solution;

(e) circulating the silver amalgam separated in the step (d) to the step (a);

(f) forming a silver amalgam with less than 30% by weight of silver content by subjecting the aqueous solution from the step (d) to an electrolytic treatment using mercury as cathode and conducted at a reaction temperature of 70° C. or higher in the presence of excessive alkali metal chloride whereby residual silver ions and mercury present in the solution are precipitated on the cathode; and (g) circulating the silver amalgam formed in the step (f) to the step (c).

5. A method as claimed in claim 4, in which the concentration of alkali metal chloride in the aqueous solution is kept at 100 g/l or more throughout the steps.

6. A method as claimed in claim 4, in which the alkali metal chloride is sodium chloride.

7. A method for separating gold and silver successively from an acidic aqueous solution containing gold and silver comprising the steps of:

(a) selectively precipitating metallic gold by adding a silver amargam with 30% by weight or more of silver content to said aqueous solution and reacting gold ions with the silver amalgam at a reaction temperature of 70° C. or higher in the presence of an excessive alkali metal chloride;

(b) separating the metallic gold from the aqueous solution;

(c) forming a silver amalgam with 30% by weight or more of silver content by adding a silver amalgam with 30% by weight or more of silver content to the aqueous solution from the step (b) and reacting silver ions present in the solution with the silver amargam at a reaction temperature of 70° C. or higher in the presence of an excessive alkali metal chloride;

(d) separating the silver amalgam from the aqueous solution;

(e) recovering a part of the silver amalgam separated in the step (d) and circulating the remainder thereof to the step (a);

(f) forming a silver amalgam with less than 30% by weight of silver content by adding an amalgam of a base metal having a great ionizing tendency than mercury to the aqueous solution from the step (d) and reacting residual silver ions and mercury ions present in the aqueous solution with the amalgam at a reaction temperature of 70° C. or higher in the presence of an excessive alkali metal chloride;

(g) separating the silver amalgam from the aqueous solution; and (h) circulating the silver amalgam separated in the step (d) to the step (c).

8. A method as claimed in claim 7, in which the concentration of the alkali metal chloride in the aqueous solution is kept at 100 g/l or more throughout the steps.

9. A method as claimed in claim 7, in which the alkali metal chloride is sodium chloride.

10. A method for separating gold and silver successively from an acidic aqueous solution containing gold and silver comprising the steps of:

(a) selectively precipitating metallic gold by adding a silver amargam with 30% by weight or more of silver content to said aqueous solution and reacting gold ions with the silver amalgam at a reaction temperature of 70° C. or higher in the presence of an excessive alkali metal chloride;

(b) separating the metallic gold from the aqueous solution;

(c) forming a silver amargam with 30% by weight or more of silver content by adding a silver amalgam with less than 30% by weight of silver content to the aqueous solution from the step (b) and reacting silver ions present in the solution with the silver amalgam at a reaction temperature of 70° C. or higher in the presence of an excessive alkali metal chloride;

(d) separating the silver amalgam from the aqueous solution;

(e) recovering a part of the silver amalgam separated in the step (d) and circulating the remainder thereof to the step (a);

(f) forming a silver amalgam with less than 30% by weight of silver content by subjecting the aqueous solution from the step (d) to an electrolytic treatment using mercury as cathode and conducted at a reaction temperature of 70° C. or higher in the presence of an excessive alkali metal chloride whereby the silver ions and mercury ions remaining in the solution are precipitated on the cathode;

(g) separating the silver amalgam from the aqueous solution; and (h) circulating the silver amalgam separated in the step (g) to the step (c).

11. A method as claimed in claim 10, in which the concentration of the alkali metal chloride in the aqueous solution is kept at 100 g/l or more throughout the steps.

12. A method as claimed in claim 10, in which the alkali metal chloride is sodium chloride.

* * * * *